US009730536B2

(12) United States Patent
Hall

(10) Patent No.: US 9,730,536 B2
(45) Date of Patent: Aug. 15, 2017

(54) PILLOW FOR SIDE SLEEPING

(71) Applicant: Raymond F. Hall, Westlake Village, CA (US)

(72) Inventor: Raymond F. Hall, Westlake Village, CA (US)

( * ) Notice: Subject to any disclaimer, the term of this patent is extended or adjusted under 35 U.S.C. 154(b) by 212 days.

(21) Appl. No.: 14/681,959

(22) Filed: Apr. 8, 2015

(65) Prior Publication Data

US 2015/0282647 A1 Oct. 8, 2015

Related U.S. Application Data

(60) Provisional application No. 61/976,972, filed on Apr. 8, 2014.

(51) Int. Cl.
*A47G 9/10* (2006.01)

(52) U.S. Cl.
CPC ..... *A47G 9/10* (2013.01); *A47G 2009/1018* (2013.01); *Y10T 29/49826* (2015.01)

(58) Field of Classification Search
CPC ..... A47G 9/10; A47G 9/1054; A47G 9/1063; A47G 9/1072; A47G 2009/1018; A47C 16/00; A47C 16/06
USPC ..... D6/595, 596, 601
See application file for complete search history.

(56) References Cited

U.S. PATENT DOCUMENTS

D318,203 S * 7/1991 Zaghini ..... 5/636
6,817,049 B1 * 11/2004 Hall ..... A47G 9/10 5/632
7,082,633 B1 * 8/2006 Maarbjerg ..... A47G 9/10 5/636
7,594,288 B1 * 9/2009 Holliday ..... A61F 5/56 5/630
8,161,588 B1 * 4/2012 Anson ..... A47G 9/109 5/630

FOREIGN PATENT DOCUMENTS

GB 1321716 A * 6/1973 ..... A47G 9/10
KR WO 2007114573 A1 * 10/2007 ..... A47G 9/109

* cited by examiner

*Primary Examiner* — Nicholas Polito
(74) *Attorney, Agent, or Firm* — Cislo & Thomas, LLP

(57) ABSTRACT

A pillow for sleeping on one's side that comfortably accommodates the user's shoulder by having an indentation at a middle section of the pillow. The indentation is created by a first interior face and a second interior face that tapers inwardly towards a center axis from lateral sides of the pillow. The first and second interior faces also taper from a top side towards the bottom side of the pillow. The indentation can be replicated on the opposite side so that the pillow can be reversible.

11 Claims, 5 Drawing Sheets

PILLOW FOR SIDE SLEEPING

CROSS-REFERENCE TO RELATED APPLICATION

This patent application claims the benefit of U.S. Provisional Patent Application Ser. No. 61/976,972 filed Apr. 8, 2014, which application is incorporated in its entirety here by this reference.

TECHNICAL FIELD

This invention relates to pillows, in particular, pillows that accommodate sleeping on one's side.

BACKGROUND

WebMD.com reports that 63 percent of Americans sleep on their side. Additionally, the side sleeping posture is recommended by sleep specialist to reduce snoring and sleep apnea as it tends to open up the airways. The rationale is that the side sleeping posture reduces the retraction and posterior translation of the mandible relative to the temporal articulation which generally occurs while one sleeps on his or her back. This more neutral position not only reduces stress on the joint itself, but also allows for improved respiratory air flow and less restriction in the oropharynx area of the throat. Furthermore, according to most specialists, sleeping on ones left side in particular reduces the propensity for heartburn and reduces the stress on the heart of a pregnant woman. Unfortunately, pillows on the market disregard proper anatomical support and needed pressure relief of the head and neck, usually propping the head up too high, thereby creating lateral stress to the joints, discs, ligaments and muscles of the neck and upper back.

For the foregoing reasons there is a need for a pillow with perfect support and comfort of the head, neck, shoulders and jaw that supports the head and neck in the neutral anatomical position for those individuals who wish to sleep on their sides.

SUMMARY

The present invention is directed to a pillow designed to support, comfort and accommodate the head, neck, shoulders, arms and jaw while a user is sleeping on his or her side. The pillow has specific heights, specific cut outs, and a front face angle that allows the shoulder and arm to have less pressure while in the anatomic side-sleeping fetal or semi-fetal position. The pillow is precisely engineered to support the spine and head, including but not limited to the temporomandibular joint, in a neutral position allowing the user to have less muscular tension, less joint stress and sleep more soundly by allowing them to pass through the 4 different phases of sleep with less disturbance as well as improving the bodies innate healing and restoration while they sleep.

The pillow has several unique design features that have very practical and essential functions. First, it will be made with different heights for various body sizes and personal preference. The front posterior face (where the shoulders meet the pillow) will have a beveled edge or tapered surface from superior to inferior to give pressure relief and room for the upper arm to pass along while in the side lying position. In the center portion of the front face, there is a soft "V-like" cut-out or indentation in the mid-portion of the front face that has two angles to accommodate and give pressure relief for the downward shoulder. Then like the front edge of the remainder of the front face of the pillow, the center V-like cut out is furthermore beveled from the superior aspect of the pillow to the inferior aspect. The upper surface of the pillow is generally flat, allowing the head to be in perfect alignment with the spine. The upper corner surfaces of the front and back face are generally slightly rounded for comfort and a softer appearance. The unique front face design is replicated on the hack face of the pillow allowing the user to turn the pillow 180 degrees for increased life and durability of the pillow.

The pillow is intended to be a shell form-general design of a side sleeping pillow for optimal support and comfort. Preferably, the pillow is made from latex foam, but the shell can be filled with air, water, poly-fibers, cotton and any other materials that create a form structure and yet still allow soft, comfortable support. Preferably, the foam is a pressure relieving and breathable latex foam.

The pillow may be manufactured by cutting the foam with a contour type cutter forming two identical pieces of foam (right and left pieces) with all of the above dimensions and angles. These two foam pieces can be joined at the center creating one mid-portion seam. Creating the two identical pieces will cut down on increased manufacturing costs. The union of the two pieces with the V-like shoulder cut out indentation in the center in the front and back faces of the pillow creates a butterfly or hour glass-like appearance when looking from the top of the pillow. The structure of the pillow with the indentations allows shoulder relief in the front and hack part of the pillow's center. In some embodiments, the pillow may be cut from a single piece of foam to create a one-piece pillow that does not have to be assembled. In some embodiments, the pillow can be created from a mold either as a one-piece or a two-piece that is assembled together.

A cotton/spandex zipped pillow case cover may be made to encase the pillow design and appearance, allowing the angles and structure to be seen and felt during use and furthermore adding support and protection.

The pillow improves people's sleep through optimal biomechanical support, pressure relief, guiding contours of the pillow design and improving comfort of the head and spine.

DETAILED DESCRIPTION OF THE INVENTION

Figure 1:
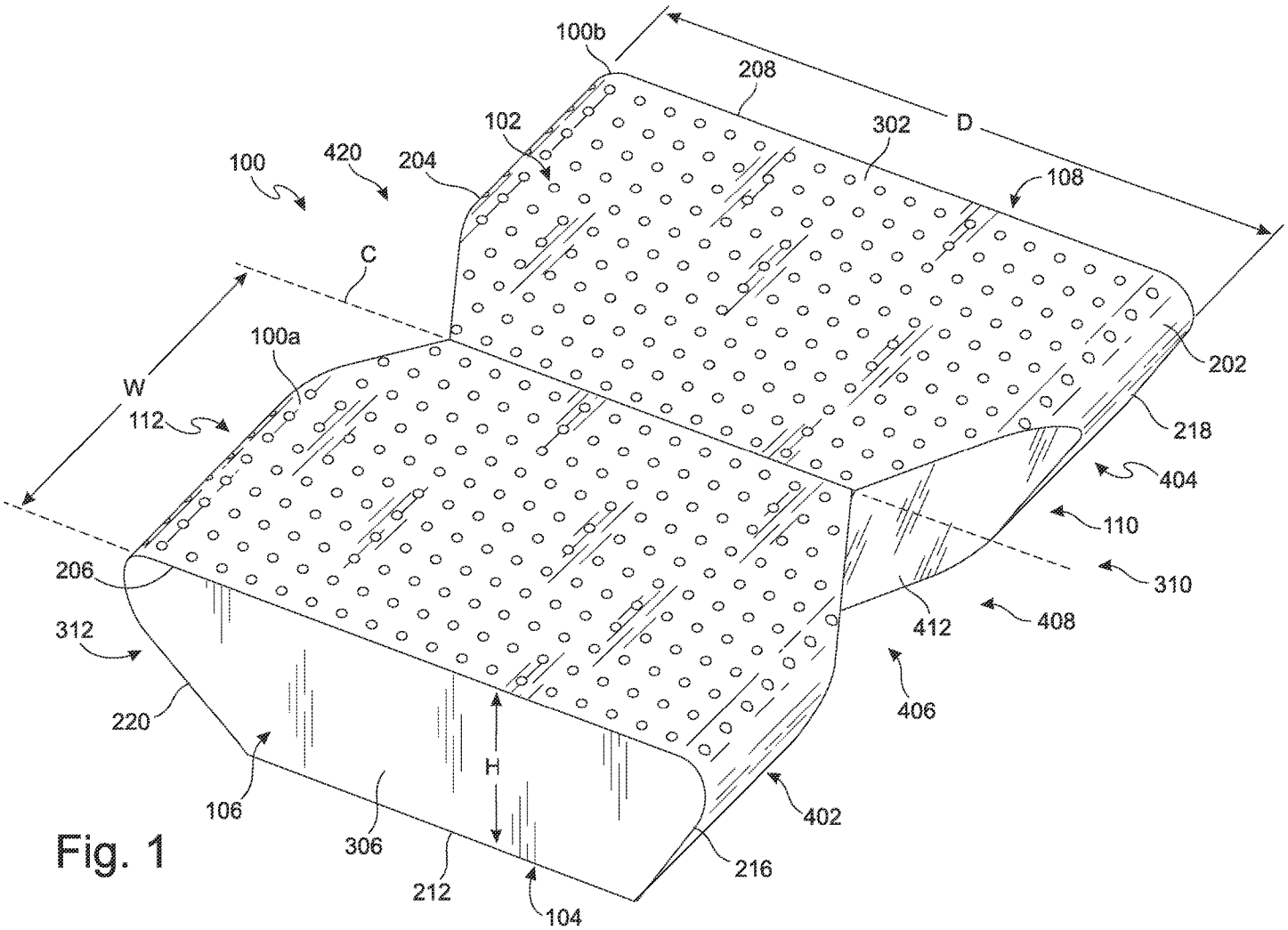
FIG. 1 shows a top perspective view of an embodiment of the present invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The pillow of the present invention is designed to accommodate a user sleeping on his or her side. As such, the medial portion of the pillow has an indentation to receive the shoulder of the user while the user's head is resting on top of the pillow. In some embodiments, there may be two indentations on opposite sides so that the pillow can be reversible. The two indentations may have the same dimensions and configurations, or they may be different to accommodate different people or different positions. The pillow itself may be of different sizes to accommodate different users.

With reference to the figures, in the preferred embodiment, the pillow 100 comprises a dorsal side 102 (also referred to as the top side or superior side); a ventral side 104 (also referred to as a bottom side or inferior side) opposite the dorsal side 102; a first lateral side 106 adjacent to the dorsal side 102 and the ventral side 104; a second lateral side 108 adjacent to the dorsal side 102 and the ventral side 104 and opposite the first lateral side 106; a posterior side 110 (also referred to as the front side) adjacent to the dorsal side 102, the ventral side 104, and the first and second lateral sides 106, 108; and an anterior side 112 (also referred to as the back side) adjacent to the dorsal side 102, the ventral side 104, and the first and second lateral sides 106, 108, and opposite the posterior side 110.

Where the dorsal or top side 102 meets the posterior or front side 110 defines a posterodorsal edge 202. Where the dorsal or top side 102 meets the anterior or back side 112 defines an anterodorsal edge 204. Where the dorsal or top side 102 meets the lateral sides 106, 108 defines a dorsolateral edge 206, 208. Since there are two lateral sides 106, 108, there are two dorsolateral edges 206, 208.

Figure 3:
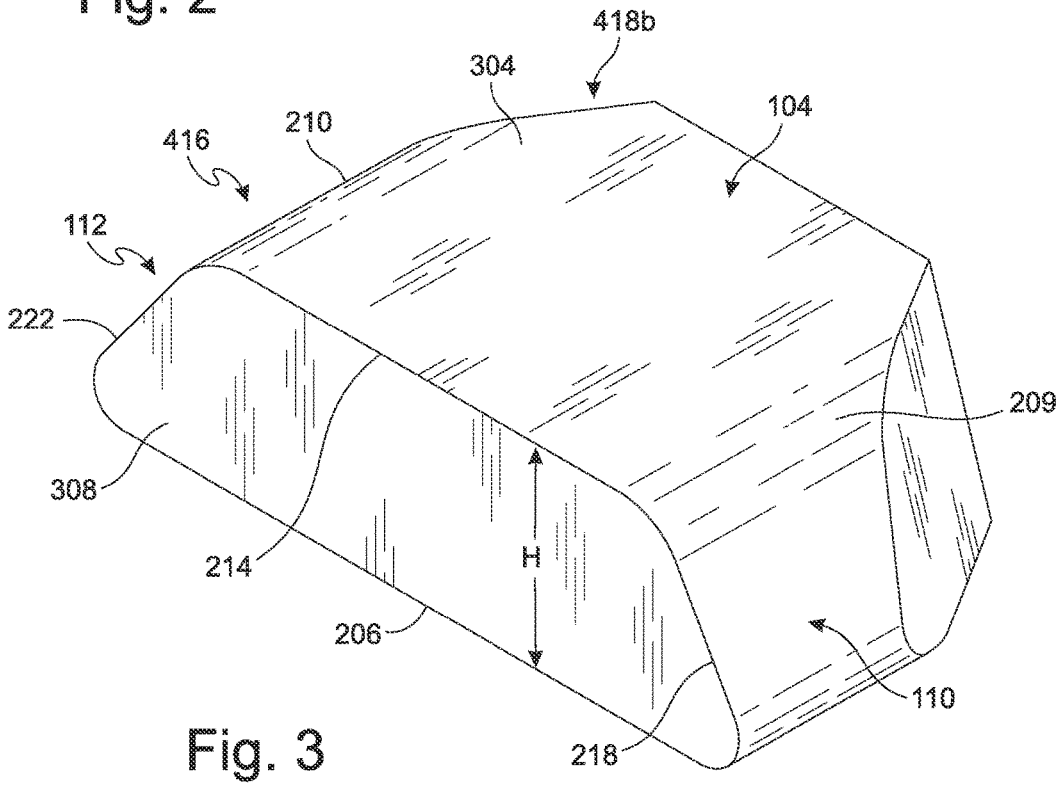
FIG. 3 shows a bottom perspective view of an embodiment of one pillow base.

Similarly, as shown in FIG. 3, where the ventral or bottom side 104 meets the posterior or front side 110 defines a posteroventral edge 209. Where the ventral or bottom side 104 meets the anterior or back side 112 defines an anteroventral edge 210. Where the ventral or bottom side 104 meets the lateral sides 106, 108 defines a ventrolateral edge 212, 214. Since there are two lateral sides 106, 108, there are to ventrolateral edges 212, 214.

Finally, where the posterior side 110 meets the lateral side 106, 108 defines a posterolateral edge 216, 218. Since there are two lateral sides 106, 108 there are two posterolateral edges 216, 218. And, where the anterior side 112 meets the lateral sides 106, 108 defines an anterolateral edge 220, 222. Since there are two lateral sides 106, 108 there are two anterolateral edges 220, 222.

Therefore, the pillow comprises a dorsal or top surface 302 on the dorsal or top side 102, a ventral or bottom surface 304 on the bottom side 104, a first lateral or left surface 306 on one of the lateral sides 106, a second lateral or right surface 308 on the other lateral side 108, a posterior or front surface 310 on the front side 110, and an anterior or back surface 312 on the back side 112. The dorsal surface 302 is defined by the posterodorsal edge 202, the anterodorsal edge 204 opposite the posterodorsal edge 202, the first dorsolateral edge 206 adjacent to the posterodorsal and anterodorsal edges 202, 204, and the second dorsolateral edge 208 opposite the first dorsolateral edge 206 and adjacent to the posterodorsal and anterodorsal edges 202, 204. The ventral or bottom surface 304 on the bottom side 104 is defined by the posteroventral edge 209, the anteroventral edge 210 opposite the posteroventral edge 209, the first ventral lateral edge 212 adjacent to the posteroventral edge 209 and the anteroventral edge 210, and the second ventrolateral edge 214 opposite the first ventrolateral edge 209 and adjacent to the posteroventral edge 209 and the anteroventral edge 210, the bottom surface 304 being opposite the top surface 302. The first lateral surface or left surface 306 on the first lateral side 106 is defined by the first posterolateral edge 216, the first anterolateral edge 220, the first dorsolateral edge 206 and the first ventrolateral edge 212, the left surface 306 being adjacent to the top surface 302 and the bottom surface 304. The second lateral or right surface 308 on the other lateral side 108 is defined by the second posterolateral edge 218, the second anterolateral edge 222, the second dorsolateral edge 206, and the second ventrolateral edge 214, the right surface 308 being opposite the left surface 306 and adjacent to the top surface 302 and the bottom surface 304. The front or posterior surface 310 is defined by the posterodorsal edge 202, the posteroventral edge 209, the first posterolateral edge 216, and the second posterolateral edge 218. The back or anterior surface 312 is defined by the anterodorsal edge 204, the anteroventral edge 210, the first anterolateral edge 220, and the second anterolateral edge 222. In addition, the pillow 100 defines a central axis C equidistant from and parallel to the left side 106 and the right side 108.

Figure 4:
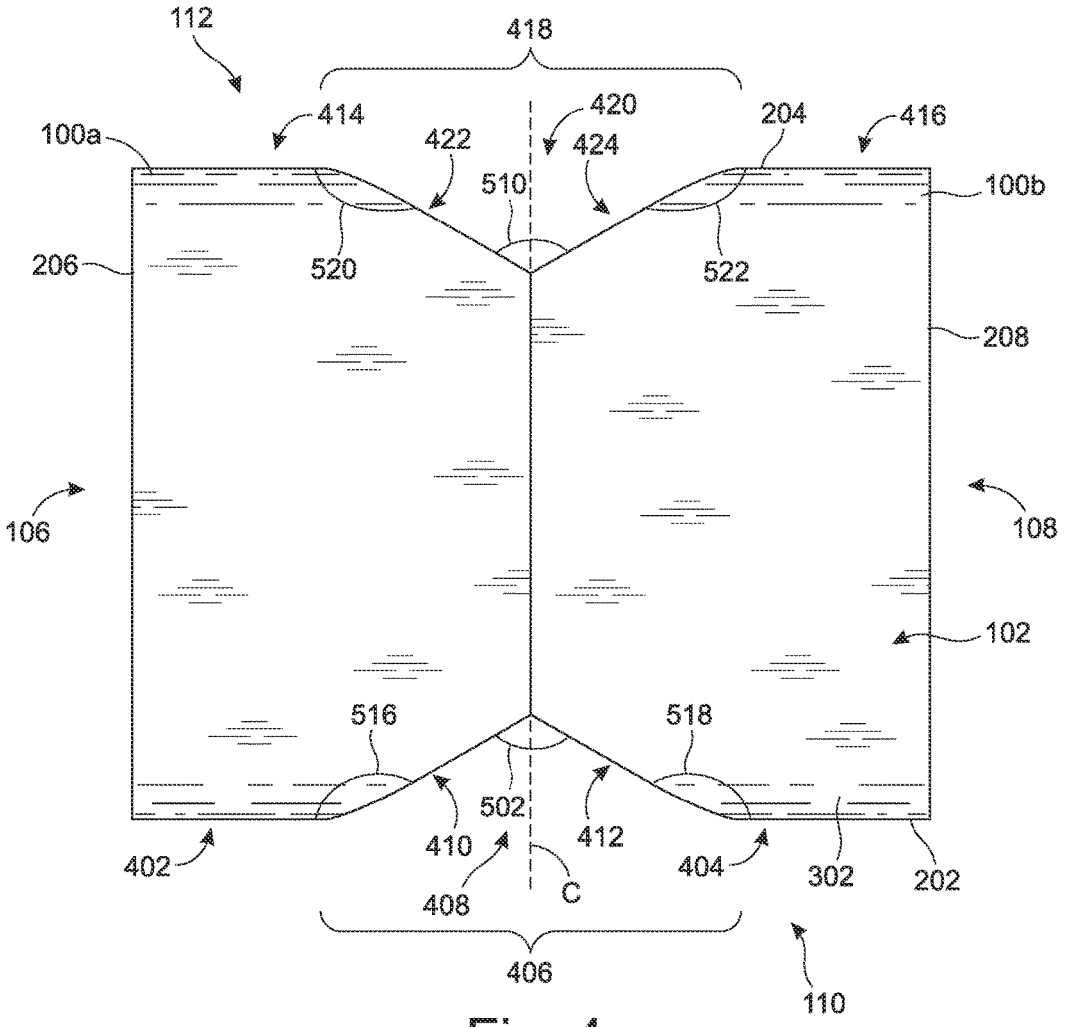
FIG. 4 show a top plan view of an embodiment of the present invention.
Figure 5:
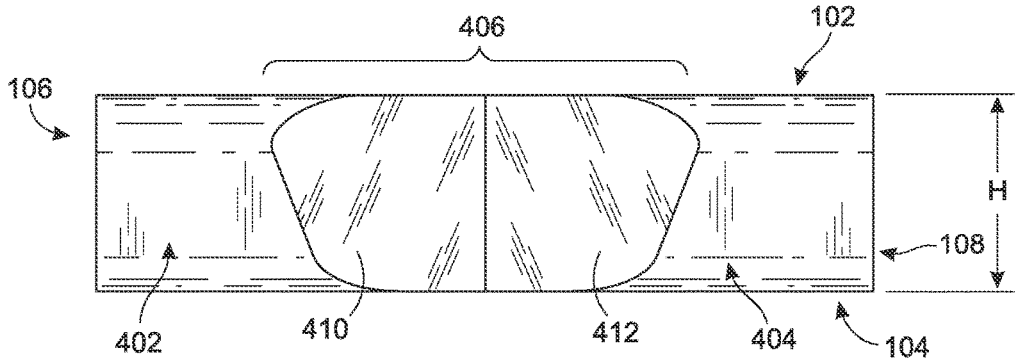
FIG. 5 shows an elevation view from the front side (or back side) of an embodiment of the present invention.

In the preferred embodiment, the front or posterior surface 310 comprises a front left section (or first posterolateral section 402), a front right section (or second posterolateral section 404), and a front middle section (or posteromedial section 406) therebetween. The posteromedial section 406 comprises a first wedge-shape cutout, also referred to as a first indentation 408, defined by a first interior face 410 and a second interior face 412, the first and second interior faces 410, 412 meeting at approximately the central axis C, as shown in FIG. 5. The first and second interior faces 410, 412 define a front central wedge angle 502 ranging from approximately 90 degrees to approximately 150 degrees, as shown in FIG. 4. Preferably, the front central wedge angle 502 is from approximately 110 degrees to approximately to approximately 130 degrees. In the preferred embodiment, the front central wedge angle 502 is approximately 120 degrees.

Figure 2:
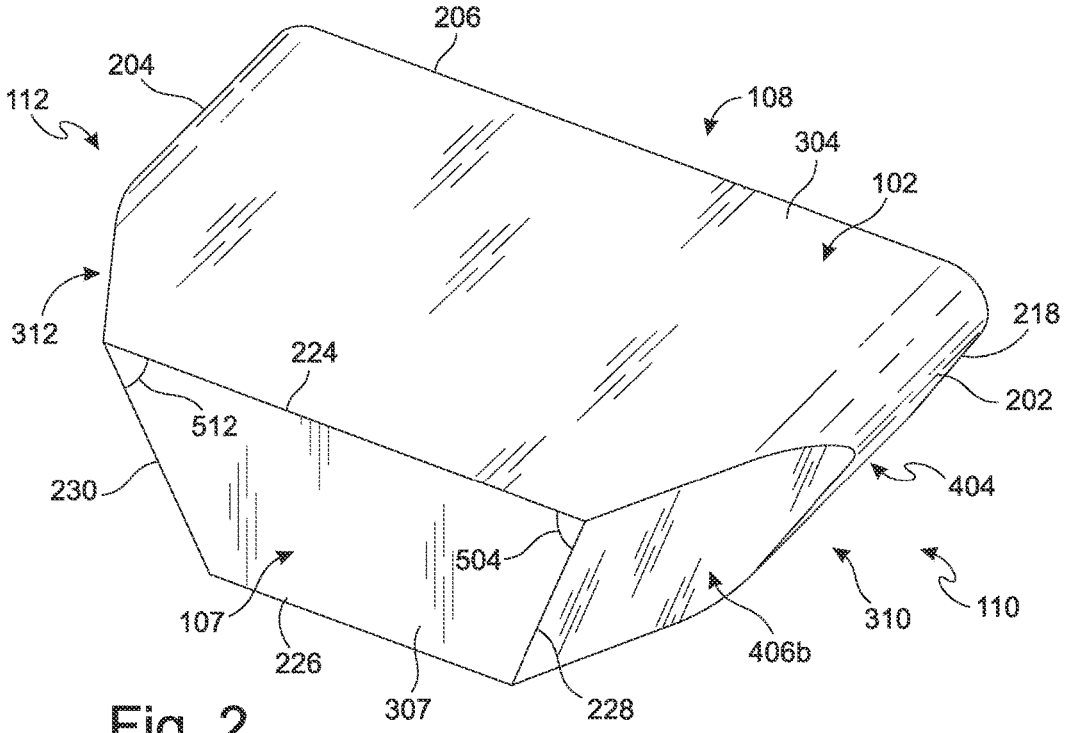
FIG. 2 shows a top perspective view of an embodiment of one pillow base.

In addition, the first interior face 410 and the second interior face 412 are beveled at the posterodorsal edge 202 so as to define top front interior face angles (or posterodorsal interior face angles 504) of approximately 65 degrees to approximately 85 degrees, as shown in FIG. 2. Preferably, the posterodorsal interior face angles 504 are approximately 70 degrees to approximately 80 degrees.

Figure 6:
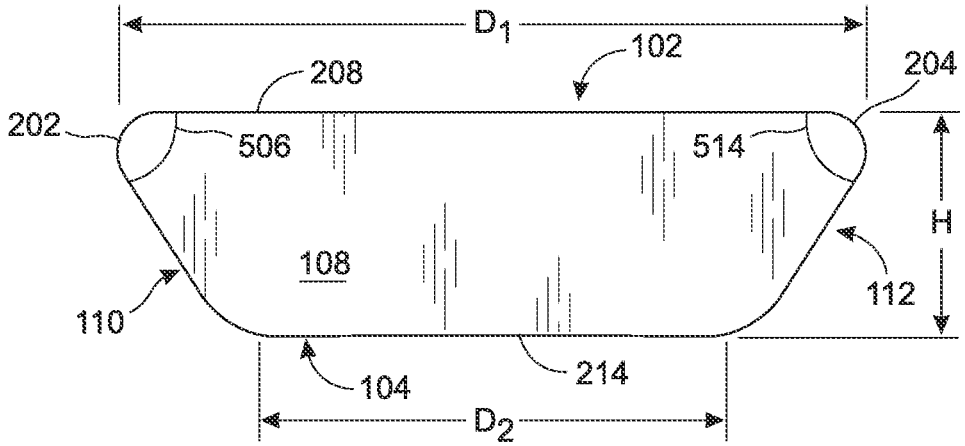
FIG. 6 shows an elevation view from a lateral side of an embodiment of the present invention.

At the front surface 310 the first posterolateral section 402 and the second posterolateral section 404 are each beveled at the posterodorsal edge 202 so as to define a top front surface angle (or posterodorsal angle 506) of approximately 45 degrees to approximately 85 degrees, as shown in FIG. 6. Preferably, the posterodorsal angle 506 is approximately 50 degrees to approximately 70 degrees. Most preferably, the posterodorsal angle 506 is approximately 60 degrees.

Similarly, the back side (anterior side 112) is defined by a back surface 312 comprising a back left section (first anterolateral section 414), a back right section (second anterolateral section 416), and a back middle section (anteromedial section 418) therebetween. The anteromedial section 418 comprises a second wedge-shape cutout, also referred to as a second indentation 420, defined by a third interior face 422 and a fourth interior face 424. The third and fourth interior faces 422, 424 meet at approximately the central axis C. The third and fourth interior faces 422, 424 define a back central wedge angle 510 ranging from approximately 90 degrees to approximately 150 degrees. Preferably, the back central wedge angle 510 is from approximately 110 degrees to approximately 130 degrees. In the preferred embodiment, the back central wedge angle 510 is approximately 120 degrees.

In addition, the third interior face 422 and the fourth interior face 424 are beveled at the anterodorsal edge 204 so as to define top back interior face angles (or anterodorsal interior face angles 512) of approximately 65 degrees to approximately 85 degrees. Preferably, the anterodorsal interior face angles 512 are approximately 70 degrees to approximately 80 degrees.

The first anterolateral section 414 and the second anterolateral section 416 are each beveled at the anterodorsal edge 204 so as to define a top back surface angle (or anterodorsal angle 514) of approximately 45 degrees to approximately 85 degrees, as shown in FIG. 6. Preferably, the anterodorsal angle 514 is approximately 50 degrees to approximately 70 degrees. Most preferably, the anterodorsal angle 514 is approximately 60 degrees.

As shown in FIG. 4, the first, second, third, and fourth interior faces 410, 412, 422, 424 also taper from their respective lateral sides 106 or 108 towards the central axis C. Preferably, the taper begins at a point between their respective posterolateral edges 216, 218 or anterolateral edges 220, 222, and the central axis C. For example, the posterior surface 310 at the first posterolateral section 402 creates a first posterior lateromedial angle 516 with the first interior face 410. The posterior surface 310 at the second posterolateral section 404 creates a second posterior lateromedial angle 518 with the second interior face 412. The anterior surface 312 at the first anterolateral section 414 creates a first anterior lateromedial angle 520 with the third interior face 422. The anterior surface 312 at the second anterolateral section 416 creates a second anterior lateromedial angle 522 with the fourth interior face 424. Each of the posterior lateromedial angles 516, 518 and the anterior lateromedial angles 520, 522 may range from approximately 135 degrees to approximately 165 degrees. Preferably, the posterior and anterior lateromedial angles 516, 518, 520, 522 range from approximately 145 degrees to approximately 155 degrees. Most preferably, the posterior and anterior lateromedial angles 516, 518, 520, 522 are approximately 150 degrees.

In order to manufacture the pillow 100 of the present invention, a piece of foam block can be cut according to the specifications above. Alternatively, the pillow 100 can be manufactured from two identical base pieces attached to together to form the pillow described above and below. In some embodiments, a mold may be created to form the pillow according to the specifications above. In some embodiments, a mold may be created to form base pieces that can be assembled according to the specifications above and below.

In the preferred embodiment, the pillow 100 is made from two identical pillow bases 100*a*, 100*b*. For convenience, only one pillow base 100*b* will be described, but the description applies to all pillow bases. As shown in FIGS. 2 and 3, the pillow base 100*b* comprises a top side 102 defining a top surface 302; a bottom side 104 defining a bottom surface 304, the bottom side 104 being opposite the top side 102; a lateral side 108 defining a lateral side surface 308, the lateral side 108 being adjacent to the top side 102 and the bottom side 104; a medial side 107 defining a medial side surface 307, the medial side 107 being opposite the lateral side 108 and adjacent to the top side 102 and the bottom side 104; a front side 110 defining a front surface 310, the front side 110 being adjacent to the top side 102, the bottom side 104, the lateral side 108, and the medial side 107; and a back side 112 defining a back surface 312, the back side 112 being adjacent to the top side 102, the bottom side 104, the lateral side 108, and the medial side 107, and opposite the front side 110. The medial side surface 307 may be defined by a dorsomedial edge 224, a ventromedial edge 226 opposite the dorsomedial edge 224, a posteromedial edge 228 adjacent to the dorsomedial edge 224 and the ventromedial edge 226, and an anteromedial edge 230 opposite the posteromedial edge 228 and adjacent to the dorsomedial edge 224 and the ventromedial edge 226. In the preferred embodiment, the dorsomedial edge 224 may be parallel to the ventromedial edge 226, but the posteromedial edge 228 and the anteromedial edge 230 are not parallel to each other. Therefore, in the preferred embodiment, the medial side surface 307 is trapezoid shape with the dorsomedial edge 224 longer than the ventromedial edge 226.

The pillow base 110*b* has a width W extending from the lateral side 108 to the medial side 107, a depth D extending from the posterior side 110 to the anterior side 112 and a height H extending from the dorsal side 102 to the ventral side 104.

Figure 7:
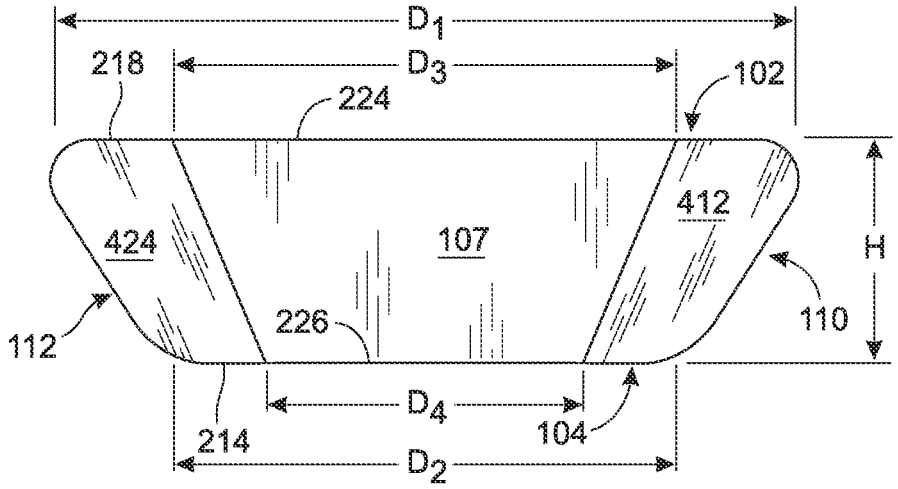
FIG. 7 shows an elevation view of a medial side of a pillow base.

In the preferred embodiment, the surfaces on the posterior side 110 and the anterior side 112 taper from the dorsal side 102 to the ventral side 104 (dorsoventral taper) as well as from the lateral side 108 towards the medial side 107 (lateromedial taper). Therefore, as shown in FIGS. 6 and 7, the depth D1 at the dorsolateral edge 208 is greater than the depth D2 at the ventrolateral edge 214, the depth D3 at the dorsomedial edge 224, and a depth D4 at the ventromedial edge 226. The depth D3 at the dorsomedial edge 224 is also greater than the depth D4 at the ventromedial edge 226. In some embodiments, the depth D2 at the ventrolateral edge 214 may be substantially the same as the depth D3 at the dorsomedial edge 224. In some embodiments, the depth D2 at the ventrolateral edge 214 may be greater than the depth D3 at the dorsomedial edge 224. In other embodiments, the depth D2 at the ventrolateral edge 214 may be less than the depth D3 at the dorsomedial edge 224.

To achieve the configuration described above, the lateral side 108 and the medial side 107 may be substantially parallel to each other. The front side 110 may be divided into two sections, a posterolateral section 404 and a posteromedial section 406*b*. The back side 112 may also be divided into two sections, an anterolateral section 416 and an anteromedial section 418*b*. In some embodiments, the lateromedial taper occurs at the posteromedial section 406*b* and the anteromedial section 418*b*. The dorsoventral taper also occurs at the posteromedial section 406*b* and the anteromedial section 418*b*. Therefore, the posteromedial section 406*b* and the anteromedial section 418*b* each comprise a double taper.

Two pillow bases 110*a*, 110*b* are assembled by joining a first pillow base 110*a* with a second pillow 110*b* base at their respective medial sides 107 so that the dorsal sides 102 of each pillow base 110*a*, 110*b* are in line with each other, thereby defining the central axis C where the medial sides 107 meet. In the preferred embodiment, the dorsal surfaces 102 of the first and second pillow bases 110*a*, 110*b* meet at approximately the central axis C at the posterior surface 310 and the anterior surface 312 at an angle of approximately 120 degrees each, thereby defining the first interior face 410 and the second interior face 412 on the posterior surface 310 adjacent to the central axis C, and the third interior face 422 and the fourth interior face 424 on the anterior surface 312 adjacent to the central axis C. Thus, when viewed from the top, the posterior side 110 and the anterior side 112 are indented at the middle. Therefore, the pillow has a hourglass or butterfly-like appearance.

In addition, in the preferred embodiment, the dorsoventral taper at the first interior face 410, the second interior face 412, the third interior face 422, and the fourth interior face 424 each defines an angle of approximately 80 degrees relative to the top surface, and each of the posterolateral sections 402, 404 and anterolateral sections 414, 416 defines an angle of approximately 60 degrees relative to the top surface. Therefore, from a side view, the lateral surfaces 306, 308 have a trapezoidal shape with the dorsolateral edges 206, 208 parallel to their respective ventrolateral edges 212, 214.

Preferably, the pillow is made from latex foam, but the shell can be filled with air, water, poly-fibers, cotton and any other materials that create a form structure and yet still allow soft, comfortable support. Preferably, the foam is a pressure relieving and breathable latex foam.

Figure 8:
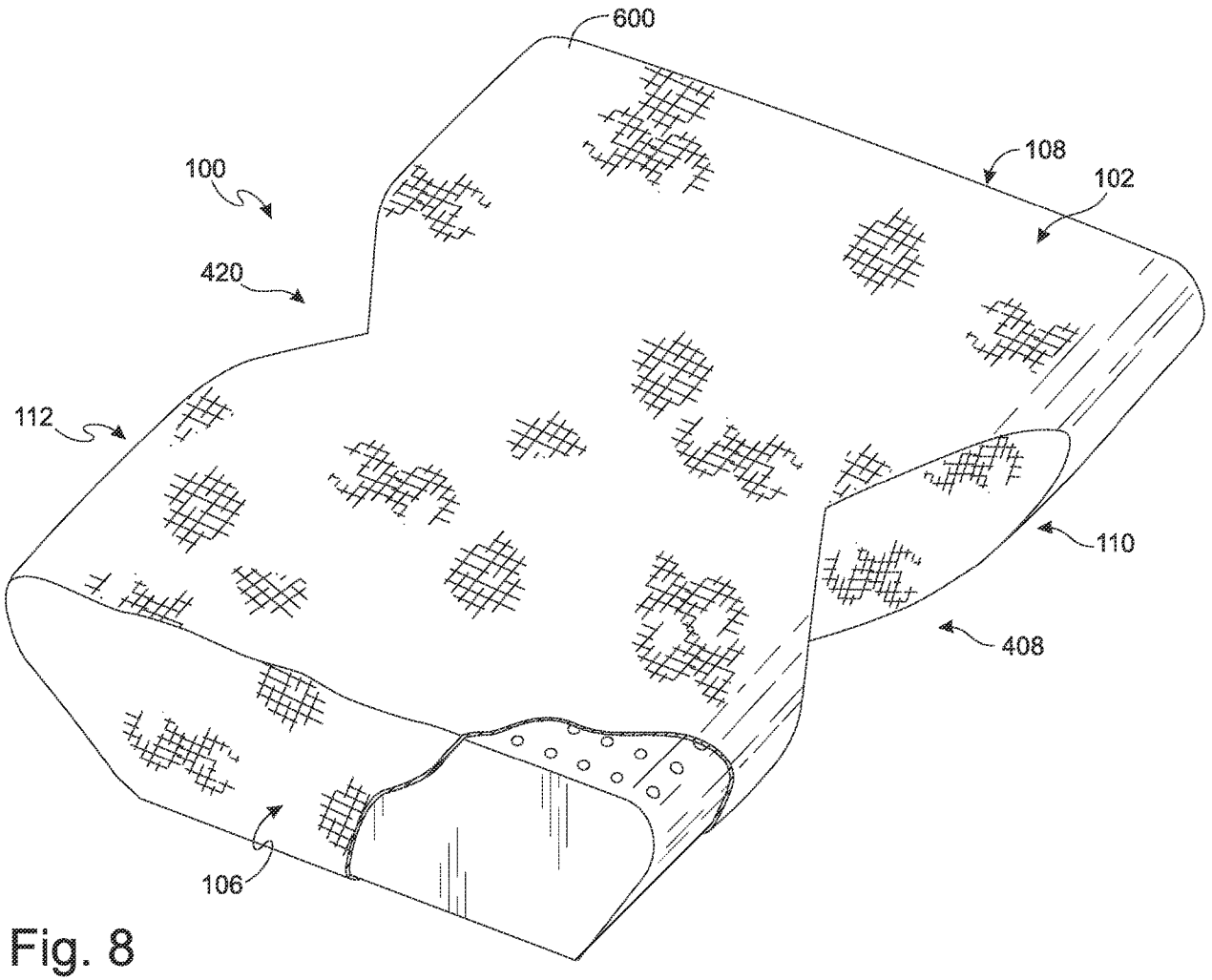
FIG. 8 shows a perspective view of an embodiment of the present invention with a pillow case.

In the preferred embodiment, as shown in FIG. 8, the pillow 100 may be enclosed in a pillow case 600. FIG. 8 shows a portion of the pillow case removed to show the pillow inside. The pillow case 600 may be made of any type of soft and comfortable material, such as cotton, spandex, and the like. Based on the configuration described, the pillow 100 accommodates the shoulder of the user for side sleeping where the first pillow base 100*a* meets the second pillow base 100*b*, or at the first and second indentations 408, 420. Based on the forgoing, variations can be devised while still keeping within the spirit and scope of the invention. For example, the tapering of the interior faces 410, 412, 422, 424 may be straight tapers or curved tapers. Any of the tapers may be the same on the posterior side 102 and the anterior side 104 for a symmetric appearance. Alternatively, the tapers may differ thereby providing indentations 408, 420 of different shapes and sizes on opposite sides so that the user can pick and choose the side that is most comfortable. Similarly, although only a front side indentation 408 and a back side indentation 420 are shown, similar indentations can be created on either or both lateral sides 106, 108. If each indentation has a slightly different configuration, then the user has a pillow 100 with four different indentation sizes to choose from that best suits the size and needs of the user. Alternatively, although the height H of the pillow has been shown as being uniform throughout, the dorsal surface 302 can actually have different heights adjacent to the respective indentations to again accommodate users of different sizes.

By way of example only, a preferred embodiment of the pillow may have a height H that will generally range from approximately 4 inches to approximately 5.5 inches. The pillow may come in three basic sizes within this range. The depth D of the pillow will be approximately 16 inches and have a total width (two base widths) of approximately 18.5 inches. The posterior and anterior surfaces 310, 312 will have a beveled edge from superior to inferior (the dorsoventral taper) with an approximate 60 degree angle 506, 514 to give pressure relief and room for the upper arm to pass along while in the side lying position. The angle 516, 518, 520, 522 creating the indentations 408, 420 when looking from above the top (superior aspect) of pillow is approximately 158 degrees, creating an approximate 2 inch indentation, with the indentation spanning approximately 8 inches (the posteromedial section 406 and anteromedial section 418) across the center of the mid portion of the pillow 100. The first, second, third, and fourth interior faces 410, 412, 422, 424 create a third angle 504, 512 of approximately 80 degrees from the superior to the inferior (dorsoventral taper).

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A pillow, comprising:

a. a dorsal side comprising a posterodorsal edge, an anterodorsal edge opposite the posterodorsal edge, a first dorsolateral edge adjacent to the posterodorsal and anterodorsal edges, and a second dorsolateral edge opposite the first dorsolateral edge and adjacent to the posterodorsal and anterodorsal edges, the posterodorsal, anterodorsal, and first and second dorsolateral edges defining a dorsal surface;

b. a ventral side comprising a posteroventral edge, an anteroventral edge opposite the posteroventral edge, a first ventrolateral edge adjacent to the posteroventral and anteroventral edges, and a second ventrolateral edge opposite the first ventrolateral edge and adjacent to the posteroventral and anteroventral edges, the posteroventral, anteroventral, and first and second ventrolateral edges defining a ventral surface, the ventral surface being opposite the dorsal surface;

c. a left side comprising a first posterolateral edge and a first anterolateral edge opposite the first posterolateral edge, the first posterolateral edge, and the first anterolateral edge in conjunction with the first dorsolateral edge and the first ventrolateral edge defining a left surface, the left surface being adjacent to the dorsal surface and the ventral surface;

d. a right side comprising a second posterolateral edge and a second anterolateral edge, the posterolateral edge and the anterolateral edge in conjunction with the second dorsolateral edge and the second ventrolateral edge defining a surface, the right surface being opposite the left surface and adjacent to the dorsal surface and the ventral surface, the pillow defining a central axis equidistant from and parallel to the first side and the second side;

e. a posterior side comprising a posterior surface defined by the posterodorsal edge, the posteroventral edge, the first posterolateral edge, and the second posterolateral edge, the posterior surface being adjacent to the dorsal surface, the ventral surface, the left surface, and the right surface, the posterior surface comprising a first posterolateral section, a second posterolateral section, and a posteromedial section therebetween, wherein the posteromedial section comprises a first wedge-shape cutout defined by a first interior face and a second interior face, the first and second interior faces meeting at approximately the central axis, wherein the first and second interior faces define a front central wedge angle of approximately 120 degrees, wherein the first interior face and the second interior face are each beveled at the posterodorsal edge so as to define posterodorsal interior face angles of approximately 80 degrees each relative to the dorsal surface, wherein the posterior surface at the first posterolateral section and the second posterolateral section are each beveled at the posterodorsal edge so as to define a posterodorsal angle of approximately 60 degrees each relative to the dorsal surface; and f. an anterior side comprising an anterior surface defined by the anterodorsal edge, the anteroventral edge, the first anterolateral edge, and the second anterolateral edge, the anterior surface being opposite the posterior surface and adjacent to the dorsal surface, the ventral surface, the left surface, and the right surface, the anterior surface comprising a first anterolateral section, a second anterolateral section, and an anteromedial section therebetween, wherein the anteromedial section comprises a second wedge-shape cutout defined by a third interior face and a fourth interior face, the third and fourth interior faces meeting at approximately the central axis, wherein the third and fourth interior faces define a back central wedge angle of approximately 120 degrees, wherein the third interior face and the fourth interior face are each beveled at the anterodorsal edge so as to define an anterodorsal interior face angle of approximately 80 degrees each relative to the dorsal surface, wherein the anterior surface at the first anterolateral section and the second anterolateral section are each beveled at the anterodorsal edge so as to define an anterodorsal angle of approximately 60 degrees relative to the dorsal surface, g. wherein the first interior face and the posterior surface at the first posterolateral section defines a first posterior lateromedial angle of approximately 150 degrees, wherein the second interior face and the posterior surface at the second posterolateral section defines a second posterior lateromedial angle of approximately 150 degrees, wherein the third interior face and the anterior surface at the first anterolateral section defines a first anterior lateromedial angle of approximately 150 degrees, and wherein the fourth interior face and the anterior surface at the second anterolateral section defines a second anterior lateromedial angle of approximately 150 degrees.

2. A pillow, comprising:

a. a top side defining a top surface;

b. a bottom side defining a bottom surface, the bottom side being opposite the top side;

c. a left side defining a left surface, the left side being adjacent to the top side and the bottom side;

d. a right side defining a right surface, the right side being opposite the left side and adjacent to the top side and the bottom side, the pillow defining a central axis equidistant from and parallel to the left side and the right side;

e. a front side defining a front surface, the front side being adjacent to the top side, the bottom side, the left side, and the right side, wherein the front side comprises a first indentation approximately midway between the left side and the right side, wherein the first indentation is defined by a first interior face and a second interior face, the first and second interior faces tapering inwardly from the top side to the bottom side; and f. a back side defining a back surface, the back side being opposite the front side and adjacent to the top side, the bottom side, the left side, and the right side, wherein the back side comprises a second indentation approximately midway between the left side and the right side, wherein the second indentation is defined by a third interior face and a fourth interior face, the third and fourth interior faces tapering inwardly from the top side to the bottom side, wherein the first and second interior faces meet at approximately the central axis at a first angle of approximately 90 degrees to approximately 150 degrees.

3. The pillow of claim 2, wherein the first interior face and the second interior face are beveled so that the first interior face and the second interior face each define a second angle of approximately 65 degrees to approximately 85 degrees relative to the top surface.

4. The pillow of claim 3, wherein the front surface adjacent to the first indentation defines a third angle of approximately 45 degrees to approximately 85 degrees relative to the top surface.

5. The pillow of claim 4, wherein the first interior face and the front surface adjacent to the first interior face define a fourth angle of approximately 135 degrees to approximately 165 degrees.

6. The pillow of claim 5, wherein the third and fourth interior faces meet at approximately the central axis at a fifth angle of approximately 90 degrees to approximately 150 degrees.

7. The pillow of claim 5, wherein the third interior face and the fourth interior face are beveled so that the third interior face and the fourth interior face each define a fifth angle of approximately 65 degrees to approximately 85 degrees relative to the top surface.

8. The pillow of claim 5, wherein the back surface adjacent to the second indentation defines a fifth angle of approximately 45 degrees to approximately 85 degrees relative to the top surface.

9. The pillow of claim 5, wherein the third interior face and the hack surface adjacent to the third interior face define a fifth angle of approximately 135 degrees to approximately 165 degrees.

10. The pillow of claim 2, wherein the front surface adjacent to the first indentation defines a second angle of approximately 45 degrees to approximately 85 degrees relative to the top surface.

11. The pillow of claim 2, wherein the first interior face and front surface adjacent to the first interior face define a second angle of approximately 135 degrees to approximately 165 degrees.

* * * * *